US007547236B1

(12) United States Patent
Chen

(10) Patent No.: US 7,547,236 B1
(45) Date of Patent: Jun. 16, 2009

(54) BOARD-TO-BOARD CONNECTOR

(75) Inventor: Chung-Yu Chen, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/129,302

(22) Filed: May 29, 2008

(51) Int. Cl.
*H01R 24/00* (2006.01)

(52) U.S. Cl. ..... 439/660; 439/74

(58) Field of Classification Search ..... 439/660, 439/66, 74, 862
See application file for complete search history.

(56) References Cited

U.S. PATENT DOCUMENTS 4,820,169 A * 4/1989 Weber et al. ..... 439/65
6,010,370 A * 1/2000 Aihara et al. ..... 439/660
7,267,582 B2 * 9/2007 Schaich ..... 439/660

* cited by examiner

*Primary Examiner*—Javaid Nasri
(74) *Attorney, Agent, or Firm*—WPAT, P.C.; Anthony King

(57) ABSTRACT

A board-to-board connector includes a socket and a plug. The socket has a dielectric housing and a plurality of receiving terminals received in the dielectric housing. The dielectric housing defines a recess and a plurality of sidewalls surrounding the recess. At least one of the sidewalls defines at least one fixing groove connecting to the recess and passing through a top portion of the sidewall. A central portion of two opposing sides of the fixing groove protrudes towards each other to form two facing fixing projections to make the central portion of the fixing groove narrower than two ends thereof. The plug engages into the recess of the socket. The plug has a dielectric body and a plurality of inserting terminals received in the dielectric body. The dielectric body protrudes sideward to form at least one locating lump corresponding to the fixing groove. The locating lump passes from between the two fixing projections by extrusion therebetween and then is blocked by the two fixing projections.

6 Claims, 4 Drawing Sheets

BOARD-TO-BOARD CONNECTOR

BACKGROUND OF THE INVENTION

1. Field of the Invention

This present invention relates to an electric connector, and more particularly to a board-to-board connector.

2. The Related Art

A conventional board-to-board connector includes a socket and a plug, and a plurality of electric terminals are received in both the socket and the plug to transmit electric signals therebetween. The socket and the plug are fixed and connected with a particular printed circuit board (PCB) respectively, and the socket and the plug electrically connect each other to transmit electric signals between the two PCBs.

However, in the traditional board-to-board connector, the socket and the plug are fixed together only via the thin and weak electric terminals. Because the electric terminals themselves cannot fix the socket and the plug together firmly in case where the board-to-board connector is hit by an external force, the socket and the plug are easy to get separated from each other.

SUMMARY OF THE INVENTION

Accordingly, an object of the invention is to provide a board-to-board connector to solve the deficiencies of the traditional board-to-board connector.

The board-to-board connector includes a socket and a plug. The socket has a dielectric housing and a plurality of receiving terminals received in the dielectric housing. The dielectric housing has a recess therein and a plurality of sidewalls cooperatively surrounding the recess. At least one of the sidewalls defines at least one fixing groove communicating with the recess and passing through a top portion of the at least one sidewall. Middles of two facing sides of the fixing groove protrudes towards each other to form two facing fixing projections to make the central portion of the fixing groove narrower than two ends thereof. The plug is engaged into the recess of the socket. The plug has a dielectric body and a plurality of inserting terminals received in the dielectric body. The dielectric body protrudes sideward to form at least one locating lump corresponding to the fixing groove. The locating lump passes from between the two fixing projections by extrusion therebetween and then is blocked by the two fixing projections.

As described above, the locating lumps arranged in the plug pass from between the fixing projections by extrusion therebetween and then are blocked by the fixing projections, and therefore, the plug and the socket are mated with each other firmly. When the board-to-board connector is hit by an external force inadvertently, the socket and the plug will still combine with each other firmly.

BRIEF DESCRIPTION OF THE DRAWINGS

The invention, together with its objects and the advantages may be best understood by reference to the following description taken in conjunction with the accompanying drawings, in which.

DETAILED DESCRIPTION OF THE PREFERRED EMBODIMENT

Figure 1:
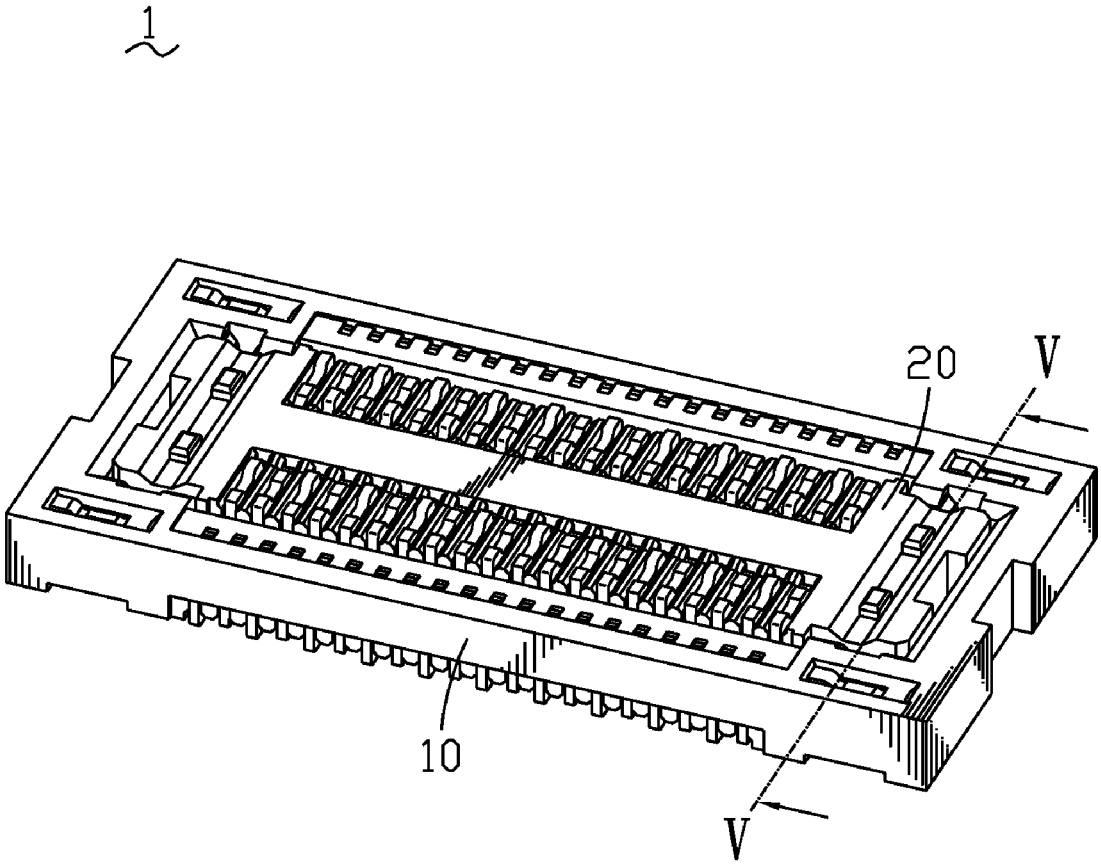
FIG. 1 is a perspective view of a board-to-board connector according to the present invention.

Please referring to FIG. 1, a board-to-board connector 1 according to the invention is shown. The board-to-board connector 1 includes a socket 10 and a plug 20 received in the socket 10. The board-to-board connector 1 is used to connect two printed circuit boards (PCB) arranged in an electronic device to transmit signals between the PCBs.

Figure 2:
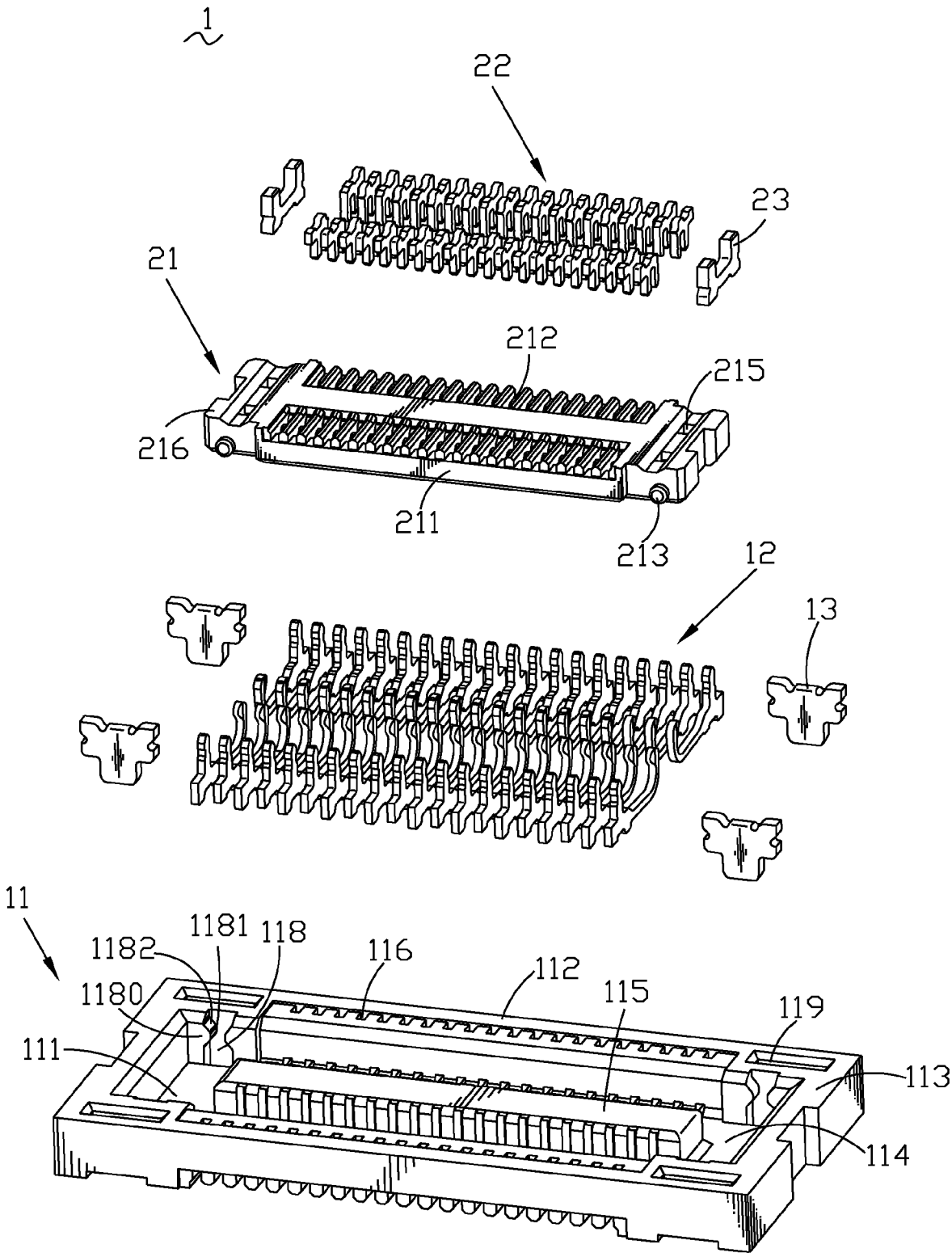
FIG. 2 is an exploded perspective view of the board-to-board connector of FIG. 1.
Figure 3:
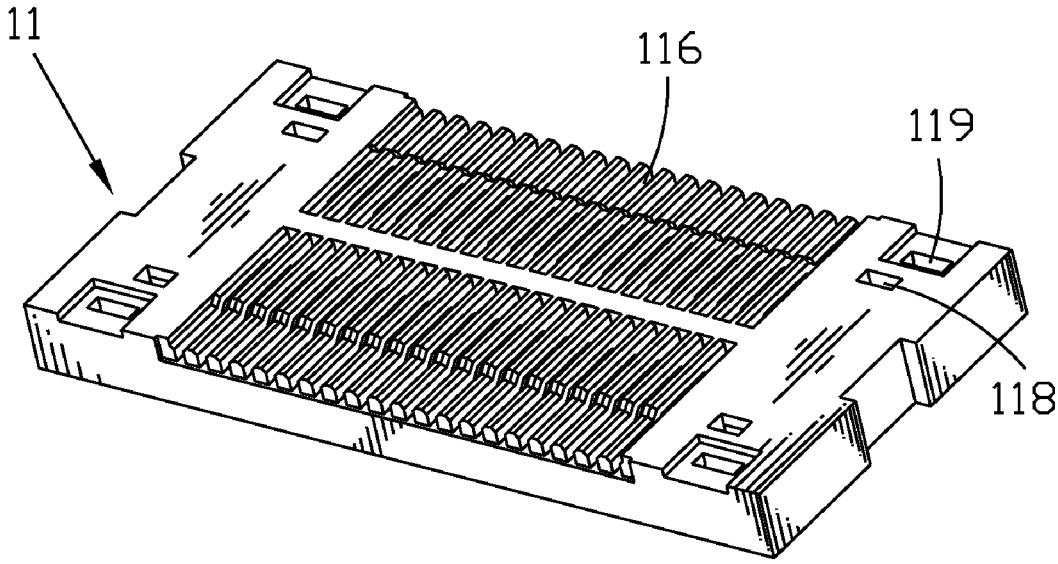
FIG. 3 is a perspective view of a dielectric housing of a socket of the board-to-board connector of FIG. 2.

Referring to FIGS. 1 and 2, the socket 10 includes a dielectric housing 11, a plurality of receiving terminals 12 and four auxiliary terminals 13, both of the terminals 12 and 13 are inserted into the housing 11 tightly. Specifically, the receiving terminals 12 are received in the dielectric housing 11 and used to transmit signals. The four auxiliary terminals 13 are arranged in the four corners of the dielectric housing 11 and also welded on a corresponding PCB to fix the socket 10 on the PCB. The dielectric housing 11 has a base 111, two parallel first sidewalls 112 extending from two opposite sides of the base 111, two second sidewalls 113 traverse to the pair of first sidewalls 112 and a central projection 115 paralleled with each first sidewall 112. The first sidewalls 112 and the second sidewalls 113 are symmetrically arranged on the base 111 respectively. The central projection 115 is raised upwardly from the middle portion of the base 111. The base 111, the first sidewalls 112, the second sidewalls 113 and the central projection 115 define cooperatively a recess 114 therebetween. Two rows of receiving grooves 116 for receiving the receiving terminals 12 are abreast defined among the first sidewalls 112, the base 111 and the central projection 115 for receiving the receiving terminals 12. Two ends of each of the two first sidewalls 112 define two fixing grooves 118 respectively, and the receiving grooves 116 are located between the fixing grooves 118. The fixing grooves 118 communicate with the recess 114 and pass through the top portion of the first sidewall 112. The central portions of two opposing sides of each fixing groove 118 protrude towards each other to form two facing fixing projections 1180 to make the central portion of the fixing groove 118 narrower than two ends thereof. The fixing projections 1180 each have a middle portion 1181 where the fixing groove 118 is narrowest with respect to the remainder, and two guiding surfaces 1182 extending opposite to each other from the middle portion 1181 to join the side of the fixing groove 118. Each corner of the dielectric housing 11 has an auxiliary groove 119 defined therein to receive a corresponding auxiliary terminal 13 therein. Bottom ends of the auxiliary terminals 13 are welded on the PCB to fix the socket 10 on the PCB.

Figure 4:
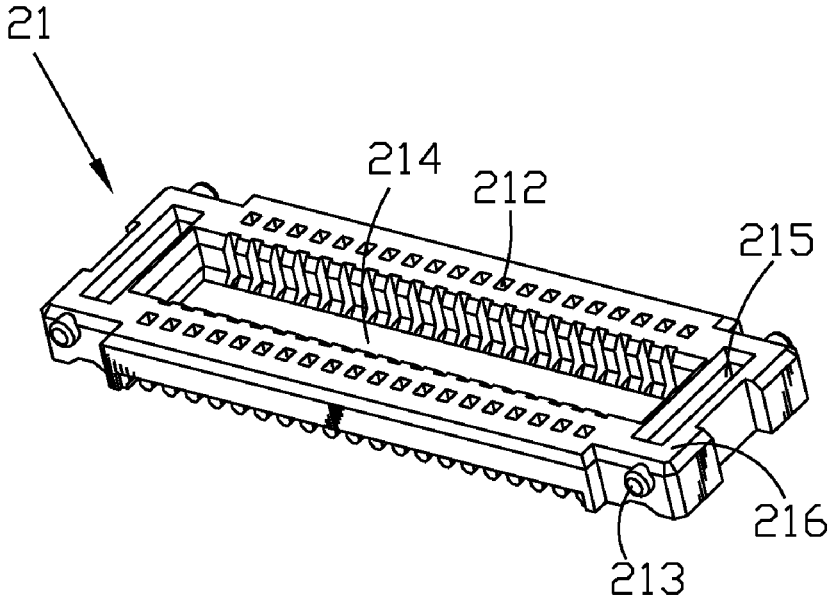
FIG. 4 is a perspective view showing a dielectric body of a plug of the board-to-board connector of FIG. 2.

In FIGS. 2 and 4, the plug 20 has a dielectric body 21, a plurality of inserting terminals 22 and two welding terminals 23. The dielectric body 21 made of plastic material has a basic portion 211 and two end portions 216 connected with two ends of the basic portion 211. The central portion of the basic portion 211 sinks to form a covering groove 214 which covers the central projection 115 after the plug 20 is inserted into the socket 10. The two end portions 216 are received in two ends of the recess 114 of the dielectric housing 11 after the plug 20 is inserted into the socket 10. Two sides of each of the end portions 216 protrude sideward to form two locating lumps 213 opposite to each other. The middle of the basic portion 211 has a plurality of holding grooves 212 for receiving the inserting terminals 22, and when the plug 20 is inserted into the socket 10, the inserting terminals 22 correspondingly connect with the receiving terminals 12. Two ends of the basic portion 211 define two welding grooves 215 to receive the welding terminals 23, and the welding terminals 23 are welded on the corresponding PCB to fix the plug 20 on the PCB.

Figure 5:
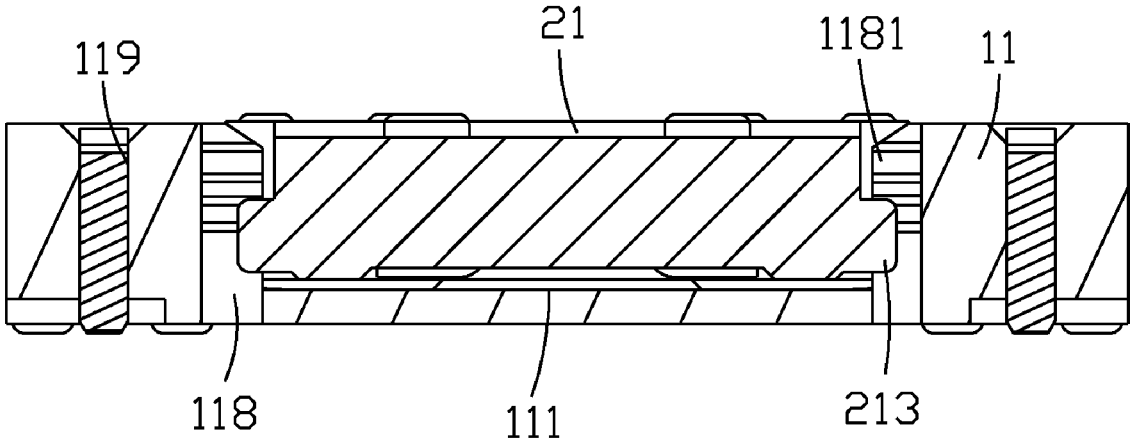
FIG. 5 is a cross-sectional view taken along line V-V of FIG. 1.

Referring to FIGS. 1, 2 and 5, when the socket 10 and the plug 20 are assembled, the central projection 115 is received in the covering groove 214, while each of the locating lumps 213 passes between the two fixing projections 1180 by extrusion therebetween and then is blocked by the two fixing projections 1180. The inserting terminals 22 connect with the receiving terminals 12 electrically.

As described above, the locating lumps 213 arranged in the plug 20 pass from between the fixing projections 1180 by extrusion therebetween and then are blocked by the fixing projections 1180, and therefore, the plug 20 and the socket 10 are mated with each other firmly. Even when the board-to-board connector 1 is hit by an external force inadvertently, the socket and the plug will still combine with each other firmly.

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. A board-to-board connector, comprising:

a socket having a dielectric housing and a plurality of receiving terminals received in the dielectric housing, the dielectric housing defining a recess therein and a plurality of sidewalls cooperatively surrounding the recess, at least one of the sidewalls defining at least one fixing groove communicating with the recess and passing through a top portion of the at least one sidewall, a central portion of two opposing sides of the fixing groove protruding towards each other to form two facing fixing projections to make a central portion of the fixing groove narrower than two ends thereof; and a plug engaged into the recess of the socket, the plug having a dielectric body and a plurality of inserting terminals received in the dielectric body, the dielectric body protruding sideward to form at least one locating lump corresponding to the fixing groove, the locating lump passing from between the two fixing projections by extrusion therebetween and then being blocked by the two fixing projections.

2. The board-to-board connector as set forth in claim 1, wherein the fixing projections respectively have a central portion where the fixing groove is narrowest relative to the remainder of the fixing groove, and two guiding surfaces extending opposite to each other from the central portion to join the side of the fixing groove together.

3. The board-to-board connector as set forth in claim 2, wherein the dielectric body has two end portions received in two ends of the recess of the dielectric housing, two sides of each of the end portions protruding sideward to form two of the locating lumps opposite to each other, the two side walls respectively define two of the fixing grooves engaged with the corresponding locating lumps and terminal cavities between the two fixing grooves.

4. The board-to-board connector as set forth in claim 3, wherein the dielectric body of the plug has a basic portion connecting the two end portions, a middle of the basic portion defines a covering groove, a bottom of the recess of the dielectric housing projects to form a central projection, and the central projection is received in the covering groove of the plug.

5. The board-to-board connector as set forth in claim 1, wherein the locating lump is respectively protruded from two opposite sides of the dielectric body, and the fixing groove is respectively defined in opposite two of the sidewalls.

6. A board-to-board connector, comprising:

a socket having a dielectric housing and a plurality of receiving terminals received in the dielectric housing, the dielectric housing defining a recess therein, and a plurality of sidewalls surrounding the recess, at least one of the sidewalls defining at least one fixing groove communicating with the recess and passing through a top portion of the sidewall, a central portion of a side of the fixing groove protruding inward to form a fixing projection to make the central portion of the fixing groove narrower than two ends thereof; and a plug engaging into the recess of the socket, the plug having a dielectric body and a plurality of inserting terminals received in the dielectric body, the dielectric body protruding sideward to form at least one locating lump corresponding to the fixing groove, the locating lump passing over the fixing projection by extrusion therebetween and then being blocked by the fixing projection.

* * * * *